US008327996B2

(12) United States Patent
Gielniewski et al.

(10) Patent No.: US 8,327,996 B2
(45) Date of Patent: Dec. 11, 2012

(54) STORE-TRANSPORT ASSEMBLY FOR ELONGATED ROD SHAPED ELEMENTS, AS WELL AS METHOD OF CONTROLLING MASS FLOW AND FILLING AND EMPTYING OF STORE-TRANSPORT ASSEMBLY FOR ELONGATED ROD SHAPED ELEMENTS

(75) Inventors: Adam Gielniewski, Radom (PL); Radoslaw Owczarek, Radom (PL); Leszek Sikora, Radom (PL); Jacek Figarski, Szydlowiec (PL); Ryszard Siara, Radom (PL)

(73) Assignee: Int'l Tobacco Machinery Poland SP.ZO.O, Radom (PL)

( * ) Notice: Subject to any disclaimer, the term of this patent is extended or adjusted under 35 U.S.C. 154(b) by 156 days.

(21) Appl. No.: 12/991,031

(22) PCT Filed: May 14, 2009

(86) PCT No.: PCT/PL2009/000048

§ 371 (c)(1),
(2), (4) Date: Feb. 2, 2011

(87) PCT Pub. No.: WO2009/139653

PCT Pub. Date: Nov. 19, 2009

(65) Prior Publication Data

US 2011/0120835 A1 May 26, 2011

(30) Foreign Application Priority Data

May 16, 2008 (PL) ..... 385206

(51) Int. Cl.
*B65G 1/00* (2006.01)

(52) U.S. Cl. ..... 198/347.1; 198/347.3

(58) Field of Classification Search ..... 198/347.1, 198/347.2, 347.3; 131/282, 283
See application file for complete search history.

(56) References Cited

U.S. PATENT DOCUMENTS 3,261,450 A 7/1966 McCombie et al.
(Continued)

FOREIGN PATENT DOCUMENTS

GB 995663 A 6/1965
(Continued)

OTHER PUBLICATIONS

International Search Report of PCT/PL2009/000048, mailing date Sep. 29, 2009.

(Continued)

*Primary Examiner* — James R Bidwell
(74) *Attorney, Agent, or Firm* — Westerman, Hattori, Daniels & Adrian, LLP

(57) ABSTRACT

Assembly having a plurality of conveyors (7, 8, 11, 23, 25, 29) and a variable capacity store (2) with one inlet (3) and one outlet (4) formed on two neighboring levels, a lower one (5) and an upper one (6), closed with a common back plate (9), fixed to a slide (13) making reciprocating movements, the concave surface (10) of which, on the interior side of the store (2) constitutes a conveyor (11), provided with a rotary arm, fixed to a slide (13), the axis of rotation of which is coaxial with a center of curvature of the surface (10) of the back plate (9), and at the inlet (3) there is a swing mounted valve element (18) and a swing limiter (26) for displacing rod shaped elements (1), whereas at the outlet (4) there is swing mounted valve element (20). Moreover the invention presents a method of controlling mass flow of rod shaped elements in the store (2) and self-filling and self-emptying of the store (2) constituting a part of the assembly disposed in a production line of products of tobacco industry.

18 Claims, 7 Drawing Sheets

U.S. PATENT DOCUMENTS

| | | | | |
|---|---|---|---|---|
| 3,297,138 | A | 1/1967 | McCombie | |
| 3,565,237 | A | 2/1971 | Strydom | |
| 3,605,988 | A | 9/1971 | McCombie | |
| 4,042,094 | A * | 8/1977 | Schmermund | 198/347.1 |
| 4,078,648 | A | 3/1978 | Hinchcliffe et al. | |
| 4,201,507 | A | 5/1980 | Hinchcliffe et al. | |
| 4,231,461 | A | 11/1980 | Hinchcliffe et al. | |
| 4,365,702 | A * | 12/1982 | Tolasch et al. | 198/347.3 |
| 5,217,101 | A | 6/1993 | Raschka | |
| 6,390,273 | B1 * | 5/2002 | Muller | 198/347.1 |
| 6,513,645 | B2 * | 2/2003 | Spatafora et al. | 198/347.1 |
| 2004/0231961 | A1 | 11/2004 | Sikora et al. | |
| 2005/0199469 | A1 * | 9/2005 | Ferrari et al. | 198/347.1 |

FOREIGN PATENT DOCUMENTS

| | | | |
|---|---|---|---|
| GB | 2007179 | A | 5/1979 |
| WO | 02/096227 | A2 | 12/2002 |

OTHER PUBLICATIONS

Written Opinion of PCT/PL2009/000048, mailing date Sep. 29, 2009.

* cited by examiner

STORE-TRANSPORT ASSEMBLY FOR ELONGATED ROD SHAPED ELEMENTS, AS WELL AS METHOD OF CONTROLLING MASS FLOW AND FILLING AND EMPTYING OF STORE-TRANSPORT ASSEMBLY FOR ELONGATED ROD SHAPED ELEMENTS

FIELD OF THE INVENTION

The subject of the invention is a store-transport assembly for elongated rod shaped elements, in particular products of tobacco industry, provided for disposing in a production line, for manufacturing said products, between a supplying device and a receiving device, as well as a method of controlling mass flow of rod shaped elements, comprising a self-acting filling and emptying of a store of variable capacity applied in the store-transport assembly.

BACKGROUND OF THE INVENTION

During manufacturing or processing rod shaped elements in tobacco industry especially filter rods, there is a necessity of using intermediate stores on trajectory of mass flow, which compensate momentary discrepancies between the number of rods being fed from a supplying device and the number of rods collected by a receiving device. Because of technological reasons the most advantageous are store units operating on the principle "first in first out" which enables full control of product flow in a production line and especially of the time of filter rods remaining in a store. Big and thus expensive buffer stores of variable capacity for example a store presented in U.S. Pat. No. 6,422,380 are not provided for usage in case of frequent changes of type of filter rods for, before a change, inside store there is a big number of rods left, which will become production waste. From description of a European patent application EP 1 310 178 a store for filter rods is known, operating on the principle "first in last out", having an accumulator as well as an inlet and outlet of filter rods, whereas inside the accumulator there is a tape element which is used to form a constant chamber which is always filled with a certain number of rods, and a storing space inside the accumulator is shaped, according to the demand, with a tape element, the length of which is variable and adapts to the number of rods delivered through the inlet reduced by the number of rods collected from the outlet. In a reverse situation, that is, for the demand for rods at the outlet being bigger than the amount of rods delivered through the inlet, the tape element shortens and thus accommodates to decreasing amount of rods in the chamber. In the description chambers of various lengths are presented, which required using various alternative control systems for the tape element. In description of another European patent EP 1 256 284 a conveyor assembly is presented for transporting a stack of cigarettes towards a hopper of a packing machine, which can be, in case of necessity, transformed into a store operating on the principle "first in first out". An upper wall of a horizontal channel leading a flow of a stack of cigarettes is rotary arranged to be lifted upwards and is arranged to be displaced in the direction of flow, whereas a top wall of an arch channel, in the area of converting horizontal flow into vertical flow, is hinge mounted between the end of the horizontal channel and the housing of the hopper. In case of the number of cigarettes collected by the hopper being decreased with relation to the number of cigarettes flowing from the horizontal channel, the rotary arranged upper wall of the channel becomes raised upwards, and in case of necessity displaced forwards, which creates temporarily a storing space above the hopper which can gather the surplus of cigarettes. Slightly different storing device working on the principle similar to "first in first out" system is known from description of European patent EP 557 933. According to this invention, between a machine producing rod shaped elements and a packing machine, a store in form of a circular conveyor is situated, having its circumference open, whereas between the ends of the conveyor a throat is created which enables passing elements onto a conveyor below a receiving conveyor connected to a packing machine, and loading elements onto the circular conveyor from a producing machine is realized by means of an inclined conveyor. The device is provided with a raw of sensors spaced on the entire trajectory of elements conveyed. For the balanced delivery and demand of elements, which is controlled by sensors, elements are transferred from the conveyor connected to the producing machine onto the conveyor connected to the packing machine, with omission of the circular conveyor, and with use of special cascade unit with rotary arranged levers which compensate minor flow fluctuations being detected respectively by sensors. For high differences between delivery and demand of elements, which is detected by sensors, elements are transferred onto the circular conveyor, from which, in case of necessity, elements are transferred onto the conveyor connected to the packing machine. A simpler device working on the system "first in first out" farming instantaneous store containers on the trajectory of mass flow of rod shaped elements, comprising several levels of flow of opposite directions of movement, and on each level it is possible to change the height of stack of cigarettes, is known from description of Japanese patent JP 58-60982. A construction which is closest to the present invention is a device for transporting cigarettes from a producing machine to a packing machine presented in description of British patent GB 985 663. The device has a store divided into an upper part, to which cigarettes are delivered from a producing machine and a lower part, from which cigarettes are transferred out to a packing machine. The end of the store is constituted by a back plate of shape of half a circle, whereas the radius of the concave part of the plate, on the store side, corresponds to the height of each level of the store, and the width of the store is slightly bigger than the length of transported cigarettes. The channel which delivers cigarettes, the inlet, the bottom of the upper and lower part and the outlet of the store are provided with conveyors, on which cigarettes are transported in form of a stack. Similarly a conveyor encircles the concave surface of the back plate of the store. Between the end plate and the conveyor constituting the bottom of the upper part of the store there is a throat of constant width enabling the flow of cigarettes into the lower part of the store. The back plate is fixed to a carriage in which said throat is arranged, and on the other side of the throat there is a return roller for the conveyor of the upper part of the store, mounted on the end plate, whereas the conveyor may change its length depending on demand for storing capacity. For the demand for bigger storing capacity the carriage, the end plate, the throat and the conveyor displace away from the inlet and for the demand for smaller storing capacity the carriage displaces towards the outlet, whereas sensors for controlling capacity changes are disposed at the inlet and outlet of the store. The store capacity depends on stoppages or slowing down the producing machine and/or packing machine.

SUMMARY OF THE INVENTION

The object of the invention is the construction of a store transport assembly for rod shaped elements, disposed in a transfer line for elements from a delivery device to a receiving device, having a plurality of substantially horizontal and vertical conveyors, and having a variable capacity store formed with the aid of said conveyors on two neighboring levels, having one inlet and one outlet, closed with a common back plate, slidably mounted so that it makes reciprocating movements parallel to the horizontal conveyors, and its concave surface, on the store side, is constituted by a chain conveyor. According to the invention the assembly is provided with a rotary arm, mounted on a slide, whose axis of rotation is coaxial with centre of curvature of a concave surface of a back plate fixed to the slide, and at an inlet of a store there is swing mounted an inlet valve element, and a swing limiter, for limiting displacement of rod shaped elements, whereas at an outlet of the store there is swing mounted an outlet valve element. The length of the rotary arm corresponds to the radius of the curvature of the concave surface of the back plate which is mounted on the slide at a distance from an axis of rotation corresponding to the length of the rotary arm. The rotary arm, on its both sides, is provided with filling sensors for filling mass flow of rod shaped elements in the area adjacent to the said arm. Both an active surface of an inlet valve element and an active surface of an outlet valve element constitute a sector of a circle of a radius corresponding to the radius of curvature of the concave surface of the back plate. Between an axis of rotation of the rotary arm and the concave surface of the back plate, in the slide there is an empty space constituting a throat for transferring rod shaped elements between levels of the store and on horizontal surfaces of the other part of the slide there is mounted an interior conveyor, whereas above the interior conveyor, before the outlet of the store there is an upward sloping conveyor. A top wall of the store is constituted by an top conveyor, and a bottom wall of the store is constituted by a bottom conveyor. A channel delivering rod shaped elements to the inlet of the store is constituted by two parallel inlet conveyors and a channel receiving rod shaped elements from the outlet of the store is constituted by two parallel outlet conveyors. Between the top conveyor of the store and a top outlet conveyor there is situated a swing cover with a position sensor. Particular movable subassemblies and/or groups of movable subassemblies are driven independently by separate motors. Such construction causes rod shaped elements to displace first in one horizontal direction, and then in opposite direction, which makes it possible to dispose an inlet and an outlet of the store close to each other and easy adapting the assembly for any arrangement of a supplying and receiving device, with unlimited length of the variable capacity store when considering the arrangement of the manufacture line. Thanks to using conveyors in each installment of the store uniform leading of mass flow is obtained both during filling and emptying of the store. During momentary changes of capacity rod shaped elements are not exposed to major displacements in relation to each other. Fitting the shape of active surfaces of swing valve elements to the curvature of the concave surface of the back plate and the top cover makes it possible to obtain gentle changes of the trajectory of mass flow.

Method according to the invention refers to controlling mass flow and to self acting filling and emptying of a variable capacity store of a store-transport assembly for rod shaped elements, disposed in a production line for products of tobacco industry, whereas the variable capacity store is formed on two neighboring levels, and mass flow of rod shaped elements between the levels is effected in direction opposite to gravity forces. According to the invention after filling an inlet chamber of the store with rod shaped elements transferred from a delivery channel through an inlet of the store, which is signalized by a swing limiter raised to its uppermost limit position with an inlet valve element removed aside, whereas flow face presses against a rotary arm situated in its lowermost vertical position, said arm, after a signal received from the swing limiter, displaces rotationally towards a back plate with the speed corresponding to the speed of in-flow of rod shaped elements into an inlet of the store, with a chain conveyor of the back plate moving simultaneously, having cross projection and aiding mass flow through a throat of a slide. After filling a minimum capacity of the store, the rotary arm stops in a horizontal position along the slide, which is followed by a removal of an outlet valve element from an outlet of the store, so that flow face of mass flow enters a receiving channel while an upwards sloping conveyor and outlet conveyors of the receiving channel operate. Self-acting increasing capacity of the variable capacity store is effected in case of output of a delivery device being bigger than output of a receiving device, which causes the slide and the back plate to move in the direction complying with the direction of transferring of rod shaped elements through the inlet of the store of the delivery channel, with such a speed of displacement in order to maintain nominal pressure of mass flow at outlet of the store, whereas the rotary arm remains in a horizontal position along the slide, and an interior conveyor of the slide with the upward sloping conveyor and a top conveyor and a bottom conveyor of walls of the store, as well as the chain conveyor of the back plate move with a respective speed providing a correct arrangement of rod shaped elements in the store. Such state may continue till obtaining maximal capacity of the store corresponding to end position of the slide. Self emptying of a store especially during changing type of rod shaped elements, which is commenced at the moment of appearing of a cleaning device following a stack of mass flow, the appearance of which causes closure of the inlet of the store by the inlet valve element, and is commenced by reducing capacity of the store with the outlet valve element being displaced aside, due to displacing the slide with the back plate in direction concurrent with the direction of displacing rod shaped elements through the outlet into the receiving channel with such a speed in order to maintain nominal pressure of mass flow at the outlet of the store, whereas the rotary arm remains disposed in a horizontal position along the slide, and the interior conveyor of the slide and the top conveyor and the bottom conveyor of the walls of the store as well as the chain conveyor of the back plate displace with an appropriate speed ensuring maintaining correct alignment of rod shaped elements in the store. Such state continues till the return of the slide to a starting position which corresponds to minimum capacity of the store for maintaining mass flow. Then the rotary arm commences its rotation in towards the inlet chamber and removes rod shaped elements out of it, and then continues its rotation till its uppermost vertical position is obtained in the area of the end of the conveyor of the top wall of the store, and next the top and the bottom conveyor of the walls of the store are stopped, the interior conveyor of the slide and the chain, conveyor of the back plate are stopped. The slide displaces farther in the direction of flow of rod shaped elements through the receiving channel, whereas the rotary arm remains in its uppermost vertical position and removes the remaining rod shaped elements through the outlet of the store with an upwards sloping conveyor and outlet conveyors of the receiving channel operating. Such method of controlling of the assembly makes it possible easy and self-acting correcting of mass flow in case of momentary variations of the number of inflowing rod shaped elements or elements being received.

BRIEF DESCRIPTION OF THE DRAWINGS

The object of the invention is presented in an embodiment in the drawing, in which.

DETAILED DESCRIPTION OF THE INVENTION

Figure 1:
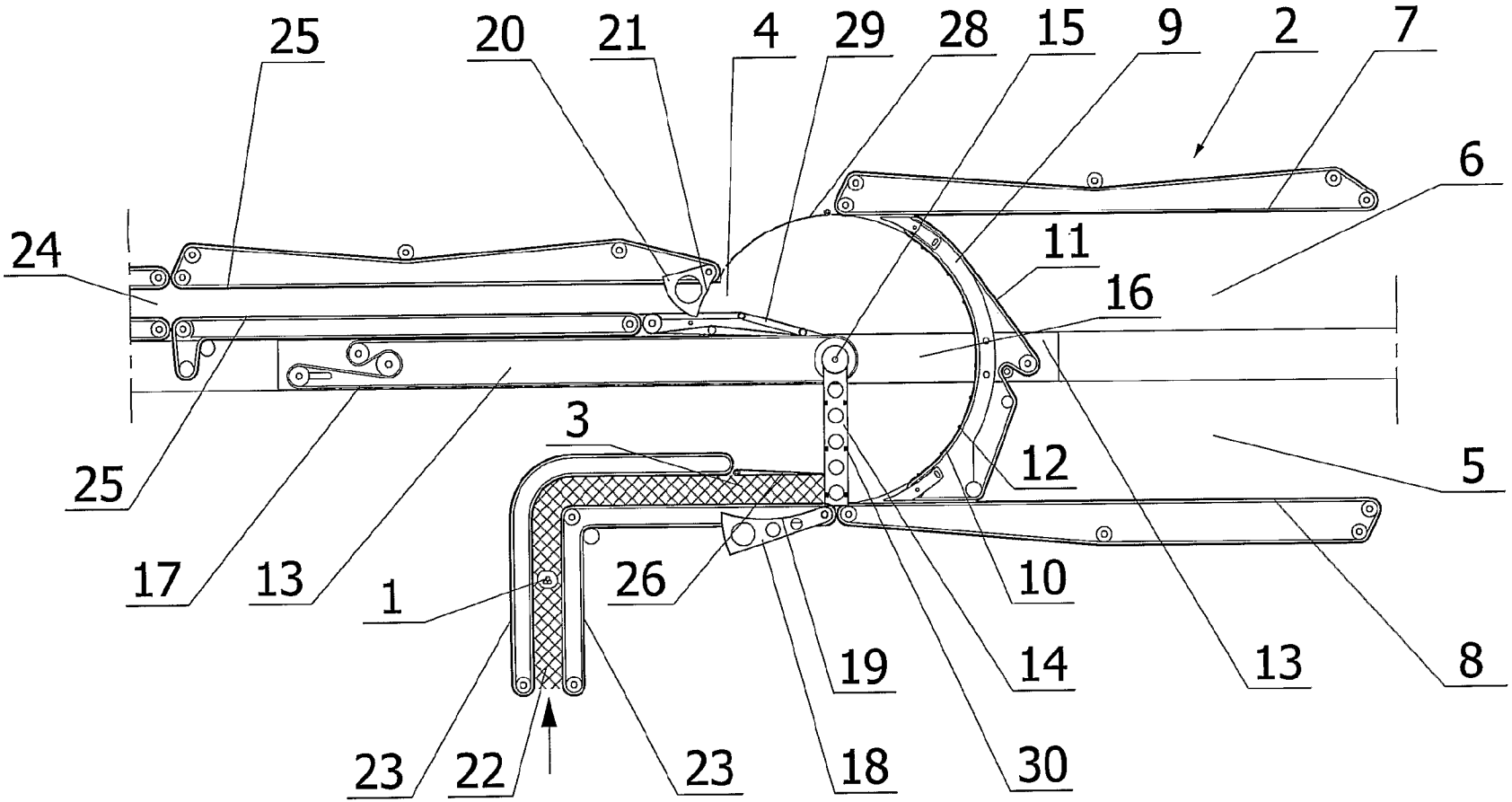
FIG. 1 shows a schematic presentation of a store-transport assembly disposed in a transfer line for rod shaped elements from a supplying device (not shown) to a receiving device (not shown), at the moment of starting delivering of rod shaped elements by a supplying device, FIG. 2—assembly of FIG. 1 after filling an inlet chamber of a variable capacity store with rod shaped elements, FIG. 3—assembly of FIG. 1 after loading a minimum capacity of the store, FIG. 4—assembly of FIG. 1 during uniform mass flow between a supplying device and a receiving device, FIG. 5—assembly of FIG. 1 with increased capacity after a receiving device has stopped receiving elements, FIG. 6—assembly of FIG. 5 after a supplying device has stopped delivering elements, FIG. 7—assembly of FIG. 6 after store capacity has been decreased to minimum as shown in FIG. 4, FIG. 8—assembly of FIG. 7 after store inlet has been closed, FIG. 9—assembly of FIG. 8 after inlet chamber of the store has been emptied, FIG. 10—assembly of FIG. 9 after minimum store capacity has been emptied, FIG. 11—assembly of FIG. 10 while removing remaining elements, and FIG. 12—assembly prepared for collecting another type of elements.
Figure 2:
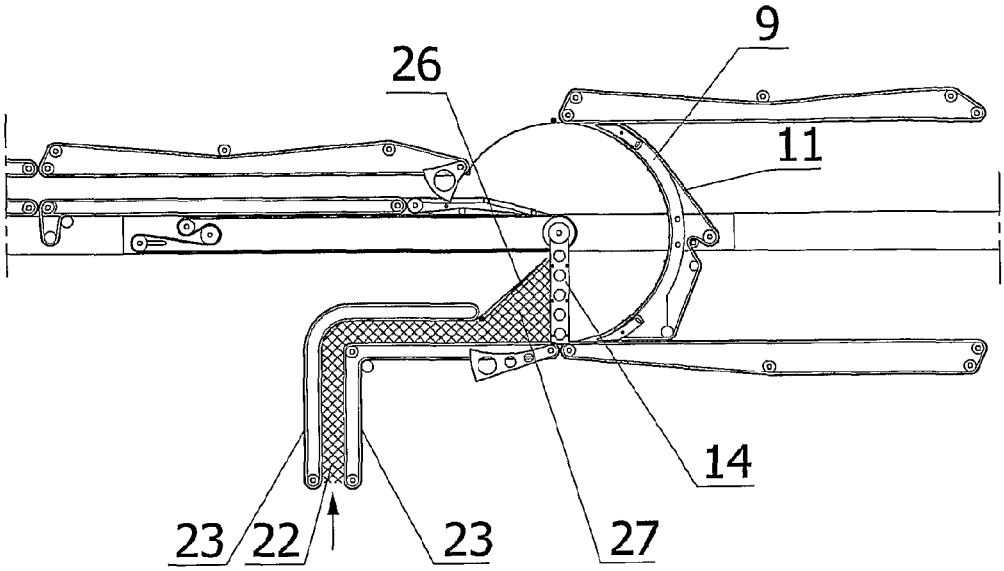
Figure 3:
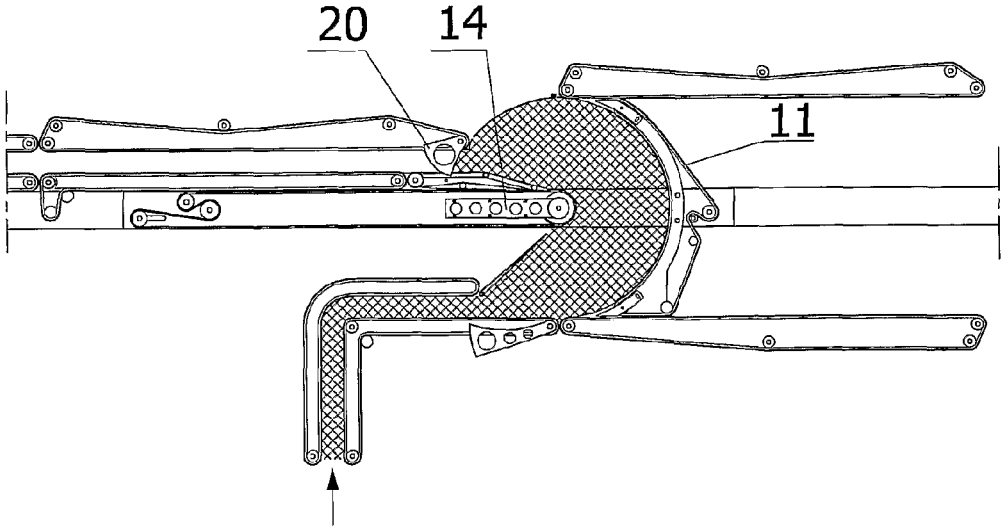
Figure 4:
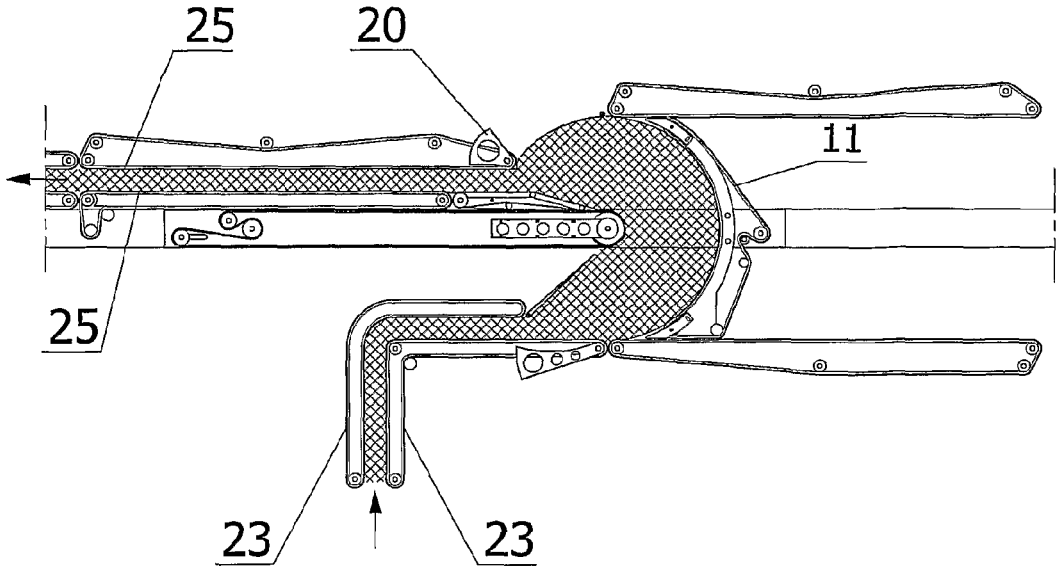
Figure 5:
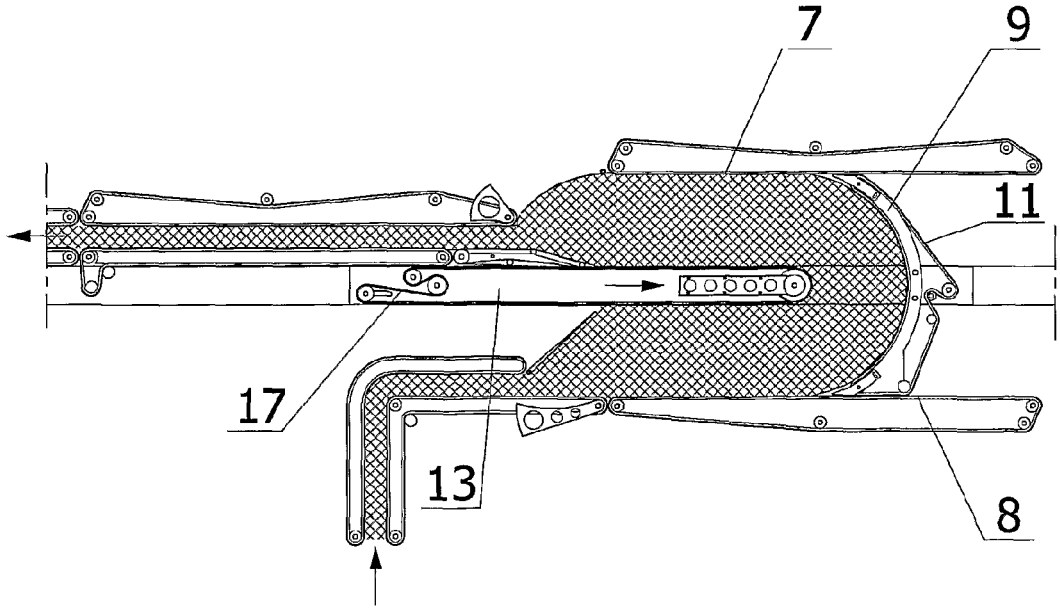
Figure 6:
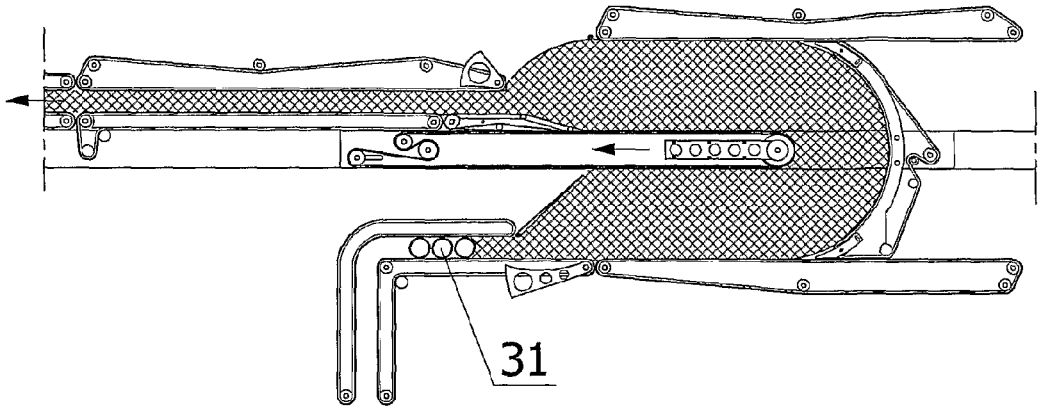
Figure 7:
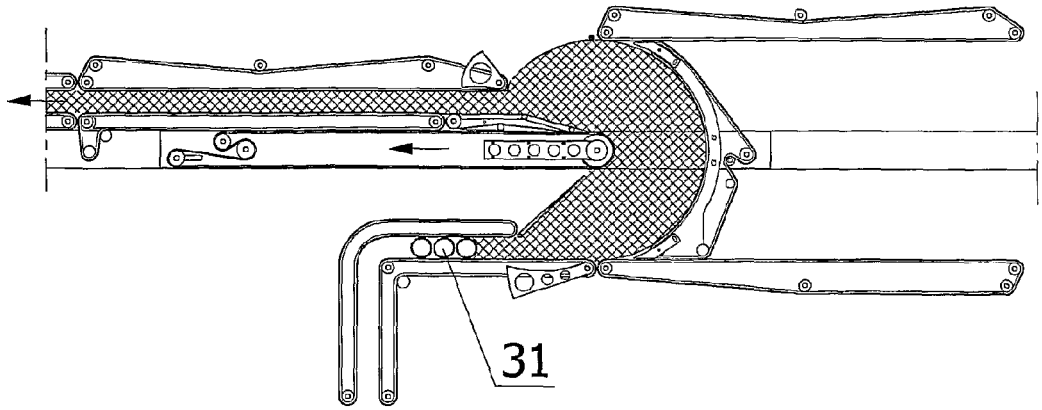
Figure 8:
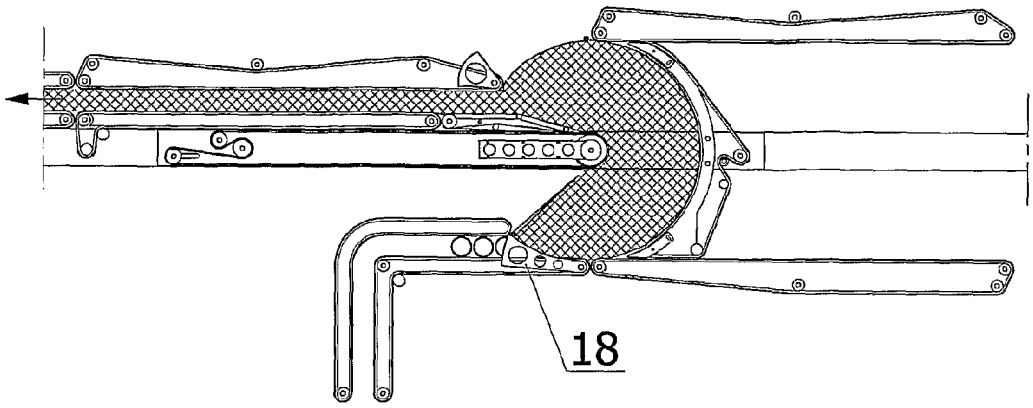
Figure 9:
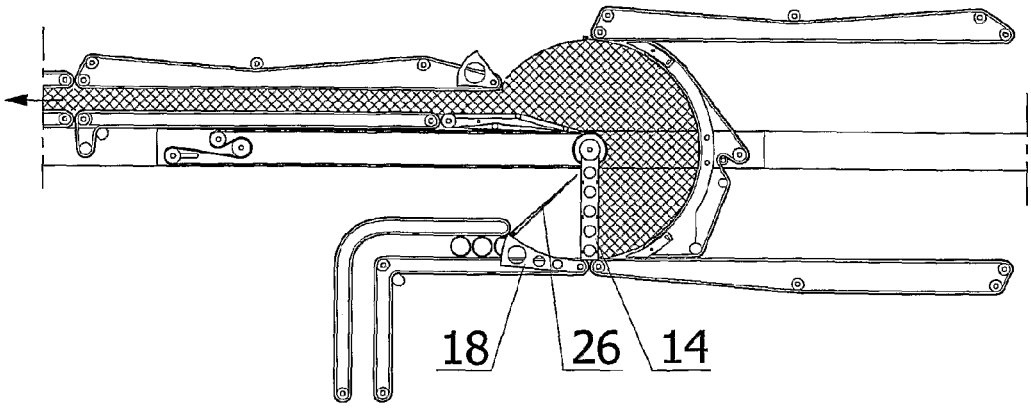
Figure 10:
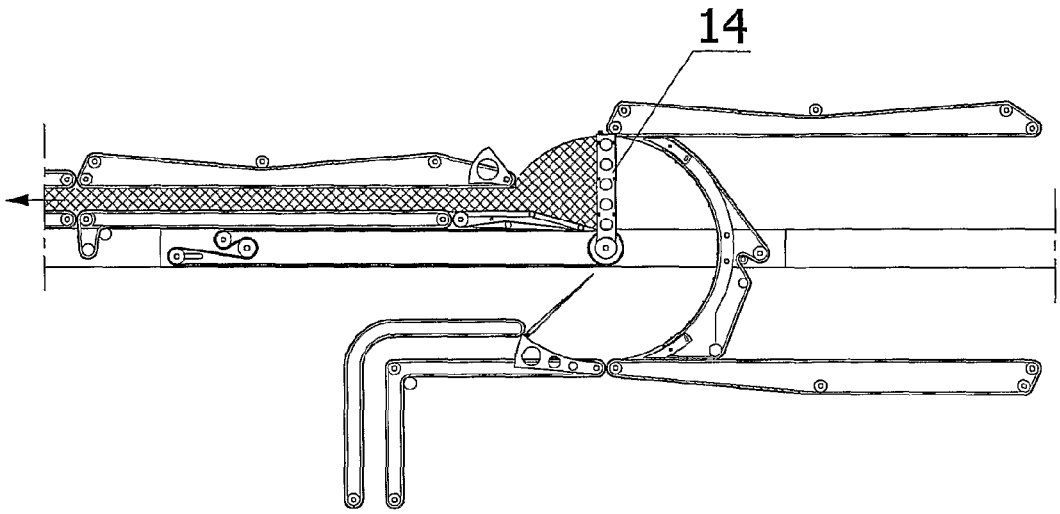
Figure 11:
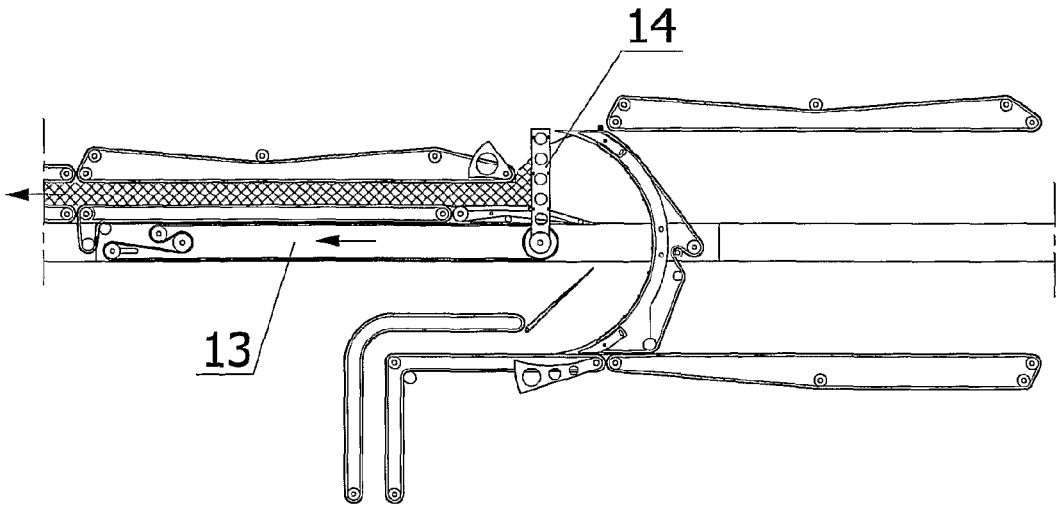
Figure 12:
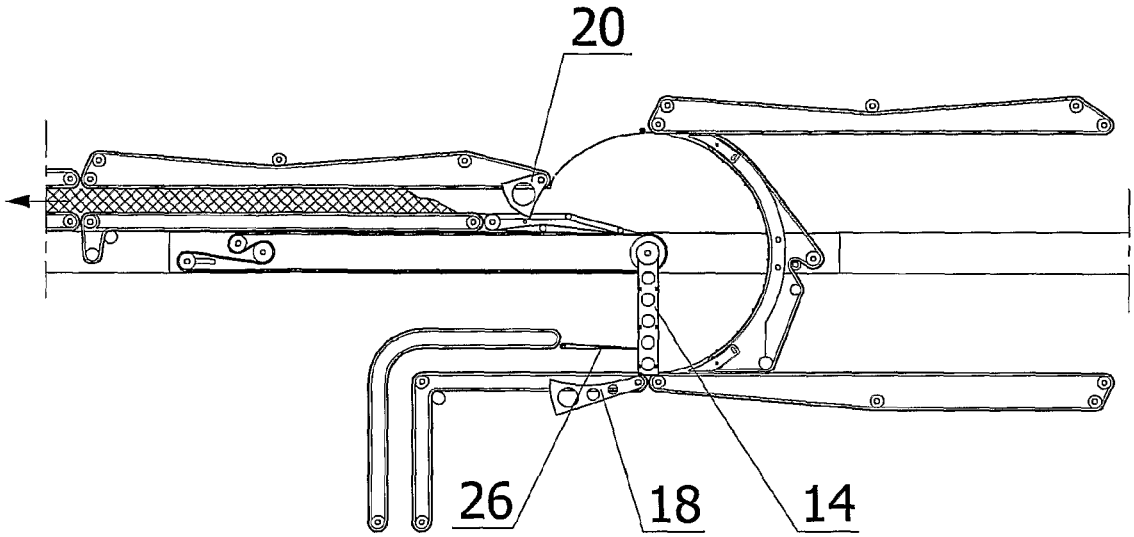

A store-transport assembly disposed in a rod transfer line for rod shaped elements 1, between a delivery device and a receiving device, having a variable capacity store 2 with an inlet 3 and an outlet 4, whereas the store 2 is situated on two neighbouring levels, a lower level 5 and an upper level 6. A top conveyor 7 constitutes a top wall of the store 2 and a bottom conveyor 8 constitutes a bottom wall of the store 2. A back plate 9, common for both levels 5 and 6 of the store 2, has, on the interior side of the store 2, a concave surface 10 constituted by a chain conveyor 11 provided with cross projections 12. The back plate 9 is fixed to the slide 13 which makes reciprocating movements along a plane separating the lower level 5 and upper level and constituting a symmetry plane of the store 2. On the slide 13 there is mounted a rotary arm 14, the axis 15 of which is coaxial with the centre of the radius of the curvature of the concave surface 10 of the back plate 9. Between the axis 15 of rotation of the arm 14 and the concave surface 10 of the back plate 9 in the slide 13 there is an empty space constituting a throat 16 for transferring elements 1 between the lower level 5 and the upper level 6 of the store 2. Horizontal surfaces of the other part of the slide 13 constitute an interior conveyor 17. The length of the rotary arm 14 is approximately equal to the radius of the curvature of the concave surface 10, whereas the back plate 9 is fixed to the slide at a distance from the axis 15 of rotation equal to the length of the arm 14. At the inlet 3 of the store 2 there is swing mounted an inlet valve element 18, whose working surface 19 constitutes a sector of a circle of the radius which corresponds to the radius of the curvature of the concave surface 10 of the back plate 9. And at the outlet 4 of the store 2 there is swing mounted an outlet valve element 20, whose working surface 21 constitutes a sector of a circle of the radius of the curvature of the concave surface 10 of the back plate 9. A channel 22 which delivers rod shaped elements 1 to the inlet 3 of the store 2 is constituted by two parallel inlet conveyors 23, whereas a channel 24 which receives rod shaped elements 1 is constituted by two parallel outlet conveyors 25. At the inlet 3 of the store 2 at the end of the upper inlet conveyor 23 there is mounted an axis of the swing limiter 26 of the flow of elements 1 which is provided with a position detector which, after lifting up by up flowing elements 1, forms an inlet chamber 27 of the store 2. At the outlet 4 at the end of the top conveyor 7 of the store 2, there is mounted an axis of a swing top cover 28 which cooperates with a position detector disposed at the end of the top conveyor 7 of the store 2. Moreover above the interior conveyor 17, at the outlet 4 of the store 2 there is mounted an upwards sloping conveyor 29 which enables passing elements 1 into the receiving channel 24. All said movable units or groups of units in form of the conveyors 7, 8, 11, 23, 25, 29, the valve elements 18, 20, the slide 13 and the rotary arm 14 are driven by independent motors not shown in the drawing. Advantageously the rotary arm 14, on its both sides, is provided with filling sensors 30 which detect empty spaces close to the arm 14 when the arm 14 rotates too fast or too slowly. There is used a cleaning device 31 for removing elements 1 after each change of brand of transported elements.

Function Description of the Invention

The functioning is described hereafter. Before commencing the work of the assembly the rotary arm 14 is situated in its vertical lowermost position, the outlet 4 is closed with the upper valve element 20, the inlet 3 is open, and the limiter 26 is positioned horizontally, whereas the slide 13 is so positioned that the axis 15 of the arm 14 is situated approximately in a plane which connects the ends of the top conveyor 7 and bottom conveyor 8. After starting a delivery device, elements 1 are transported along the delivery channel 22, while the inlet conveyors 23 for the inlet chamber 27 of the store 2 are in operation. Elements 1 of the flow face press the arm 14 and lift the limiter 26 gradually. After filling the inlet chamber 27, which is signalised by a position detector of the limiter 26, the arm 14 starts its rotary movement, and then a chain transporter 11, provided with cross projections 12 for aiding flow of elements 1 through a throat 16 of slide 13 from level 5 to 6 of the store 2, is put into motion. At that time filling sensors 30 detect empty spaces in the vicinity of the arm 14, which may appear in case of the rotation being too slow or too rapid. After filling a minimum capacity of the store 2 the arm 14 becomes positioned horizontally along the slide 13. The upper valve element 20 becomes removed from the outlet 4, and then the upwards sloping conveyor 29 and the outlet conveyors 25 are put into motion. Elements 1 are displaced along the receiving channel 24 to a receiving device. In case of equal efficiencies of a supplying device and a receiving device the slide 13 does not change its position, and in case of different outputs of said machines the slide 13 changes its position, which results in changing capacity of the store 2. During increasing capacity of the store 2 the slide 13 commences its movement in the direction complying with the direction of the flow of elements 1 into the level 5 of the store 2, while simultaneous operating of the top conveyor 7 and the bottom conveyor 8 and the internal conveyor 17 of the slide 13. During decreasing the capacity of the store 2 the slide 13 commences its motion in the direction complying with the direction of the flow of elements 1 out of the level 6 of the store 2 while outlet conveyors 23 are stopped or their speed is reduced. In case when the demand for elements 1 is smaller than the output of a supplying machine, the speed of operating of the conveyor 25 reduces and the slide 13 commences its motion in the direction complying with the direction of delivering elements 1 into the store 2. If the speed of the movement of the slide 13 is not calculated properly, the pressure within mass flow may increase instantly, which is detected by a sensor of position of a top cover 28. Information about the position from the sensor is used to adjust the speed of movement of the slide 13. Self acting emptying of the store 2, for example after the change of type of elements 1, is started at the moment of entering of a cleaning device 31 into the inlet 3 of the store 2, which causes the bottom valve element 18 to close the inlet 3. If the store 2, at that moment, has a big capacity, the capacity becomes reduced by the movement of the slide 13 down to a position which corresponds to the minimum capacity of the store 2. Then the arm 14 commences its rotation and removes elements 1 first out of the inlet chamber 27, and then out of the minimum capacity of the store 2 including the throat 16, while the conveyors 23 are motionless. Then the arm 14 is disposed in its vertical uppermost position, the conveyors 7 and 8, the internal conveyor 17 and the chain conveyor 11 are stopped and the slide 13 continues its movement in the same direction and causes that the arm 14 removes all the remaining elements 1 through the outlet 4 into the receiving channel 24, while the outlet conveyors 25 and upwards sloping conveyor 29 are in operation.

The invention claimed is:

1. Store transport assembly for elongated rod shaped elements, disposed in a transfer line for elements from a delivery device to a receiving device, having a plurality of substantially horizontal and vertical conveyors, and having a variable capacity store formed with the aid of said conveyors on two neighboring levels, having one inlet and one outlet, closed with a common back plate, slidably mounted so that it makes reciprocating movements parallel to the horizontal conveyors, and its concave surface, on the store side, is constituted by a chain conveyor, characterized in that it is provided with a rotary arm, mounted on a slide, whose axis of rotation is coaxial with centre of curvature of a concave surface of a back plate fixed to the slide, and at an inlet of a store there is swing mounted an inlet valve element, and a swing limiter, for limiting displacement of rod shaped elements, whereas at an outlet of the store there is swing mounted an outlet valve element.

2. Assembly as in claim 1, characterized in that the length of the rotary arm corresponds to the radius of the curvature of the concave surface of the back plate which is mounted on the slide at a distance from an axis of rotation corresponding to the length of the rotary arm.

3. Assembly as in claim 2, characterized in that the rotary arm, on its both sides, is provided with filling sensors.

4. Assembly as in claim 1, characterized in that an active surface of an inlet valve element constitutes a sector of a circle of a radius corresponding to the radius of curvature of the concave surface of the back plate.

5. Assembly as in claim 1, characterized in that an active surface of an outlet valve element constitutes a sector of a circle of a radius corresponding to the radius of curvature of the concave surface 10 of the back plate.

6. Assembly as in claim 1, characterized in that between an axis of rotation of the rotary arm and the concave surface of the back plate in the slide 13 there is an empty space constituting a throat for transferring rod shaped elements 1 between levels of the store.

7. Assembly as in claim 1, characterized in that on horizontal surfaces of the other part of the slide there is mounted an interior conveyor.

8. Assembly as in claim 7, characterized in that above the interior conveyor, before the outlet of the store there is an upward sloping conveyor.

9. Assembly as in claim 1, characterized in that a top wall of the store is constituted by a top conveyor, and a bottom wall of the store is constituted by a bottom conveyor.

10. Assembly as in claim 1, characterized in that a channel delivering rod shaped elements to the inlet of the store is constituted by two parallel inlet conveyors.

11. Assembly as in claim 1, characterized in that a channel receiving rod shaped elements from the outlet of the store is constituted by two parallel outlet conveyors.

12. Assembly as in claim 8, characterized in that between the top conveyor of the store and a top outlet conveyor there is situated a swing cover with a position sensor.

13. Assembly as in claim 1, characterized in that particular movable subassemblies and/or groups of movable subassemblies are driven independently by separate motors.

14. Assembly as in claim 6, characterized in that on horizontal surfaces of the other part of the slide there is mounted an interior conveyor.

15. Assembly as in claim 11, characterized in that between the top conveyor of the store and a top outlet conveyor there is situated a swing cover with a position sensor.

16. Method of controlling mass flow and self acting filling and emptying of a variable capacity store of a store-transport assembly for rod shaped elements, disposed in a production line for products of tobacco industry, whereas the variable capacity store is formed on two neighboring levels, and mass flow of rod shaped elements between the levels is effected in direction opposite to gravity force, characterized in that, after filling an inlet chamber of the store with rod shaped elements transferred from a delivery channel through an inlet of the store, which is signalized by a swing limiter raised to its uppermost limit position, with an inlet valve element removed aside, whereas flow face presses against a rotary arm situated in its lowermost vertical position, said arm, after a signal received from the swing limiter, displaces rotationally towards a back plate with the speed corresponding to the speed of in-flow of rod shaped elements into an inlet of the store, with a chain conveyor of the back plate moving simultaneously, having cross projection and aiding mass flow through a throat of a slide, and after filling a minimum capacity of the store, the rotary arm stops in a horizontal position along the slide, which is followed by a removal of an outlet valve element from an outlet of the store, so that flow face of mass flow enters a receiving channel while an upwards sloping conveyor and outlet conveyors of the receiving channel operate.

17. Method as in claim 16, characterized in that, self-acting increasing capacity of the variable capacity store is effected in case of output of a delivery device being bigger than output of a receiving device, which causes the slide and the back plate to move in the direction complying with the direction of transferring of rod shaped elements through the inlet of the store from the delivery channel, with such a speed of displacement in order to maintain nominal pressure of mass flow at outlet of the store, whereas the rotary arm remains in a horizontal position along the slide, and an ulterior conveyor of the slide with the upward sloping conveyor and a top conveyor and a bottom conveyor of walls of the store, as well as the chain conveyor of the back plate move with a respective speed providing a correct arrangement of rod shaped elements in the store and such state may continue till obtaining maximal capacity of the store corresponding to end position of the slide.

18. Method as in claim 16, characterized in that self emptying of a store especially during changing type of rod shaped elements, which is commenced at the moment of appearing of a cleaning device following a stack of mass flow, the appearance of which causes closure of the inlet of the store by the inlet valve element, and is commenced by reducing capacity of the store with the outlet valve element being displaced aside, due to displacing the slide with the back plate in direction concurrent with the direction of displacing rod shaped elements through the outlet into the receiving channel with such a speed to maintain nominal pressure of mass flow at the outlet of the store, whereas the rotary arm remains disposed in a horizontal position along the slide, and the interior conveyor of the slide and the top conveyor and the bottom conveyor of the walls of the store as well as the chain conveyor of the back plate displace with an appropriate speed ensuring maintaining correct alignment of rod shaped elements hi the store and such state continues till the return of the slide to a starting position which corresponds to minimum capacity of the store for maintaining mass flow, and then the rotary arm commences its rotation towards the inlet chamber and removes rod shaped elements out of it, and then continues its rotation till its uppermost vertical position is obtained in the area of the end of the conveyor of the top wall of the store, and next the top and the bottom conveyor of the walls of the store are stopped, the interior conveyor of the slide and the chain conveyor of the back plate are stopped and then the slide displaces farther in the direction of flow of rod shaped elements through the receiving channel, whereas the rotary arm remains in its uppermost vertical position and removes the remaining rod shaped elements through the outlet of the store with an upwards sloping conveyor and outlet conveyors of the receiving channel operating.

* * * * *